United States Patent [19]

Gale, Jr.

[11] 4,251,015

[45] Feb. 17, 1981

[54] COMBINED FRAME FOR TENT FIELD ENLARGING PACK

[76] Inventor: Floyd C. Gale, Jr., 5138 N. 82nd St., Scottsdale, Ariz. 85253

[21] Appl. No.: 13,873

[22] Filed: Feb. 22, 1979

[51] Int. Cl.[2] ..... A45F 3/10; A45F 1/16; A45F 4/04

[52] U.S. Cl. ..... 224/154; 135/1 R; 135/4 R

[58] Field of Search ..... 135/1 R, 4 R; 224/153, 224/154

[56] References Cited

U.S. PATENT DOCUMENTS

| | | | |
|---|---|---|---|
| 2,836,334 | 5/1958 | Davis | 224/153 |
| 3,158,299 | 11/1964 | Weir et al. | 224/153 |
| 3,560,015 | 2/1971 | Tracy | 224/153 X |
| 3,799,415 | 3/1974 | Tidd | 224/153 |
| 3,822,813 | 7/1974 | Carter | 135/1 R X |
| 3,923,217 | 12/1975 | Dean et al. | 135/1 R X |
| 3,931,918 | 1/1976 | Smith et al. | 224/154 |
| 4,077,418 | 3/1978 | Cohen | 224/154 X |

FOREIGN PATENT DOCUMENTS

| | | | |
|---|---|---|---|
| 2331301 | 6/1977 | France | 224/154 |

*Primary Examiner*—J. Karl Bell

[57] ABSTRACT

There is disclosed herein an frame apparatus for use as a backpack frame in one configuration and as a tent frame in another configuration. The frame members are shaped and sized so as to nest within each other in the backpack configurations. In the tent configuration, six structural elements from the top of the backpack frame are disassembled and then reassembled in the tent frame configuration. Such an arrangement obviates the need for carrying separate frame components for the tent. It also simplifies the process of erecting the tent since one end of the tent is permanently attached to the portion of the backpack which is attached to the portion of the backpack frame which remains unchanged. The tent is simply rolled and the frame members comprising the tent frame are slipped through sleeves formed along the front edge of the tent. In the preferred embodiment the frame members are made of aluminum and slip together without means for fastening one member inside another.

3 Claims, 8 Drawing Figures

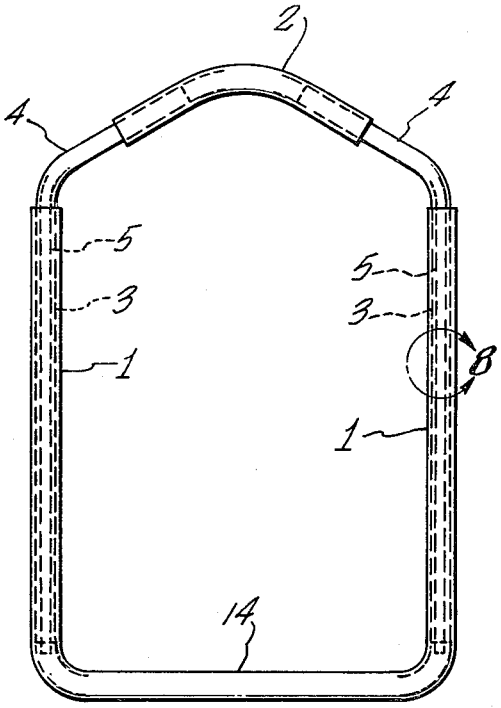
FIG. 1
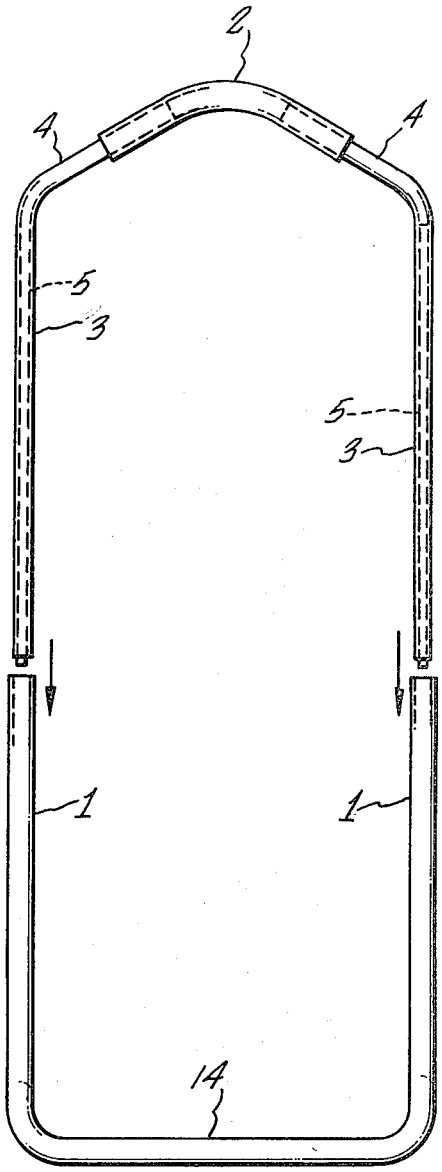
FIG. 2
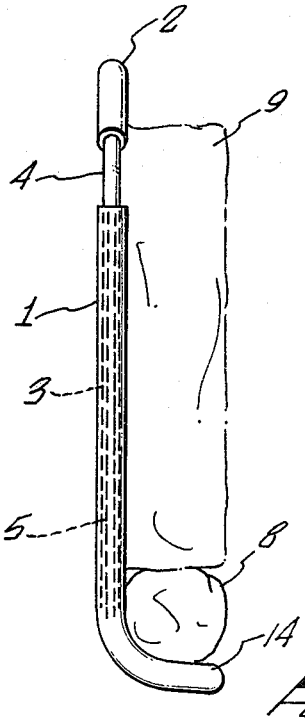
FIG. 3
FIG. 8
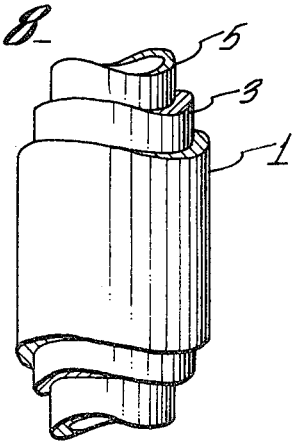

COMBINED FRAME FOR TENT FIELD ENLARGING PACK

BACKGROUND OF THE INVENTION

The invention relates generally to the field of package and articles carriers and more particularly to knapsack frames which are convertible to tent frames.

Specifically there is disclosed herein a frame for a backpack which can be partially disassembled without aid of tools and quickly reassembled into a frame for a tent attached to the backpack. The tent can stand alone with the aid of support ropes without need for an external support such as a tree.

Various means have been devised in the prior art for converting backpack frames into tent frames. One such device is exemplified in the Carter patent, U.S. Pat. No. 3,822,813. There a backpack frame is illustrated which has a generally "L" shaped configuration. When conversion to a tent frame is desired, the short section of the "L" is strapped to an upright pole or tree. A pair of second frame members which are pivoted at the top of the "L's" and fastened by a pin at the opposite end are unpinned and unfolded to align themselves with the long portion of the "L's" and horizontal to the ground. A second pair of extensions telescope out of this first pair of extensions and thereby form the tent frame as two horizontal, parallel members from which the tent hangs. The tent is carried in folded state inside the backpack. The first pair of extensions are affixed in their extended positions by pins through aligning holes in the first pair of extensions.

The present invention fills several needs unfilled by the Carter device. First, no tree is needed to support the tent frame. The tent frame is self-supporting with the lower half of the pack frame providing vertical support on one end of the tent. The reassembled components of the top half of the pack frame provide a tent frame vertical support on the open end of the tent. Although guy wires or ropes are needed on each end of the tent frame of the present invention, such a configuration should be more stable in high winds than the Carter frame which is unsupported at the end away from the tree. Finally, no space in the pack is taken up by the tent in the present invention as in Carter since the tent is affixed to the bottom of the backpack and not inside it.

SUMMARY OF THE INVENTION

The present apparatus involves a backpack with tent attached thereto which combination is attached to a backpack frame. The backpack frame can be disassembled and reassembled into a tent frame. Disassembly of the backpack frame involves removal of the top of the backpack frame and reassembling the six pieces so removed into a rooflike fame structure having two vertical legs. The bottom portion of the backpack frame then functions as the support for the rear portion of the tent and the rooflike frame structure forms the support for the front open end of the tent. To erect the tent, it is only necessary to unroll the tent from the bottom of the backpack and slip the frame members forming the rooflike frame structure through sleeves formed along the front edge of the tent fabric.

The applicant has recognized that the extra weight and inconvenience of carrying separate frame members for assembly into a tent frame can be eliminated by use of a backpack frame which is convertible into a tent frame.

BRIEF DESCRIPTION OF THE DRAWINGS

FIG. 1 is a front view of the frame apparatus in the backpack frame configuration.

FIG. 2 is a front view of the backpack frame after the first stage of disassembly in preparation for conversion to the tent frame configuration.

FIG. 3 is a side view of the backpack frame with pack and tent attached.

FIG. 8 is sectioned view of the relationship of the members of the backpack frame as assembled in the backpack configuration taken at "8" in FIG. 1.

DESCRIPTION OF THE PREFERRED EMBODIMENT

Figure 4:
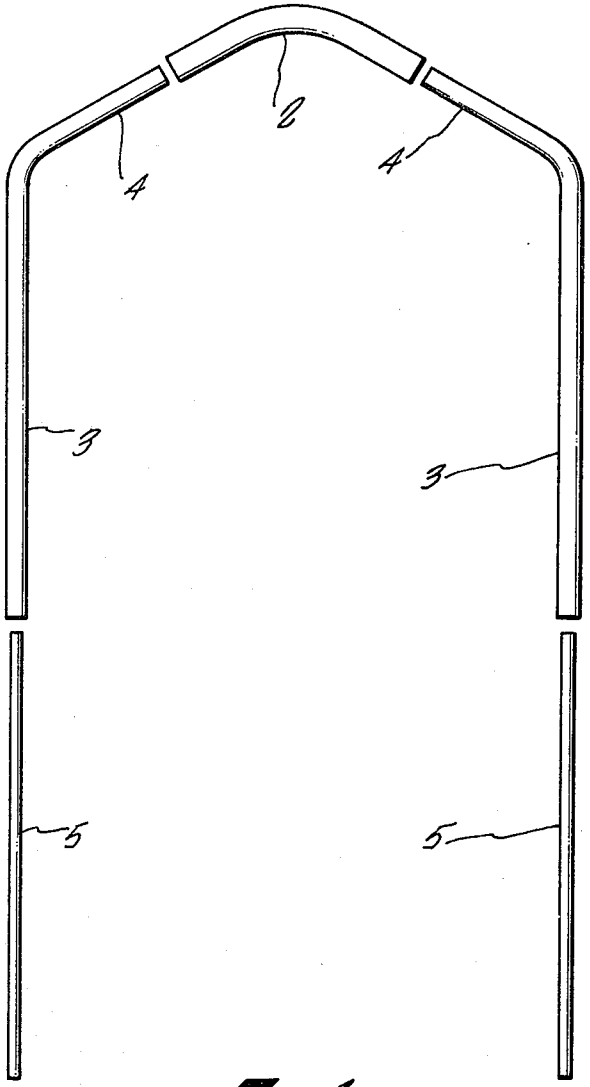
FIG. 4 is an exploded view of the six frame components comprising the top of the backpack frame in non-nested form.

In FIG. 1 the frame apparatus is shown in the backpack frame configuration. All pieces of the frame are aluminum tubing in the preferred embodiment but could be made of plastic or other lightweight but strong material. In this configuration, the six frame components comprising the top portion of the backpack frame as shown in FIG. 4, are nested together and then nested within the upright tubular sections 1 of the bottom portion of the backpack frame. The bottom member 14 holds upright tubular sections 1 in upright, parallel relationship. The nesting of these six frame components comprising the top portion of the backpack frame in the backpack frame configuration of FIG. 1 is best illustrated by the exploded view of FIG. 4. As seen there, the crown piece 2 is of slightly larger inside dimension than the corresponding outside dimensions of roof pieces 3. As seen in FIGS. 1 and 2, crown piece 2 receives the curved ends 4 slide into the ends of crown piece 2 until the curvature of crown piece 2 stops the penetration of curved ends 4. Roof pieces 3, as seen in FIGS. 2 and 4 have a slightly larger inside dimension than the corresponding outside dimension of leg pieces 5. Leg pieces 5 fit inside the long portion of roof pieces 3. Thus it is seen that in the backpack frame configuration of FIG. 1 leg pieces 5 are nested inside roof pieces 3 which in turn are nested inside the upright tubular sections 1 of the bottom portion of the backpack frame.

Figure 5:
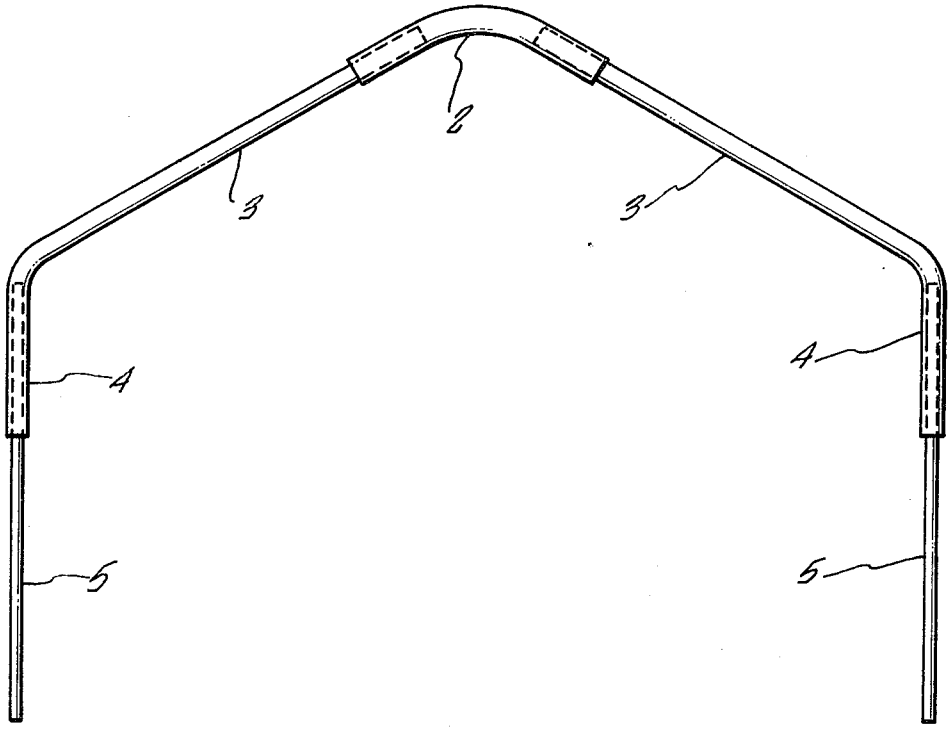
FIG. 5 is a front view of the six frame components of FIG. 4 as assembled in the tent frame configuration.

To convert the backpack frame into the tent frame configuration, roof pieces 3 are withdrawn from the upright tubular sections 1 of the bottom portion of the backpack frame as shown in FIG. 2. This is done by grasping the roof pieces 3 or the crown piece 2 and pulling up or away from the bottom 1 of the backpack frame. Then the curved ends 4 of roof pieces 3 are withdrawn from crown piece 2 and leg pieces 5 are removed from inside roof pieces 3 as shown in FIG. 4. To assemble the tent frame configuration of FIG. 5, roof pieces 3 are reversed so that the end opposite the curved and may be inserted in the crown piece 2 till the curvature of crown piece 2 stops penetration. Leg pieces 5 are then inserted into curved ends 4 of roof pieces 3 till penetration is stopped by the curvature of the curved ends 4. The tent frame configuration is then complete.

Figure 6:
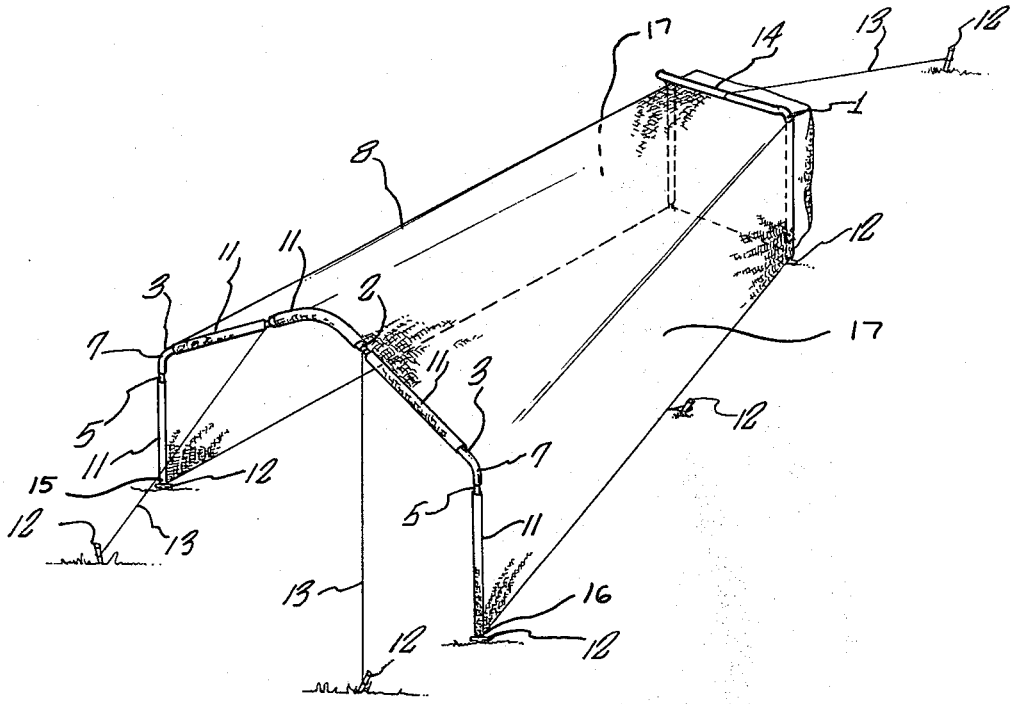
FIG. 6 is a view in perspective of the tent as erected.

The backpack (9 in FIG. 3) is attached to the upright tubular sections 1 of the backpack frame and the tent is attached to the bottom member 14 of the backpack frame. The bottom portion of the backpack frame serves as the vertical support for the rear end of the tent. An external support such as a guy wire or rope 13 and stakes 12 are needed to hold the bottom portion 1 of the backpack frame in a vertical position. The tent 8 is then unrolled from the bottom member 14 of the backpack frame and erected as shown in FIG. 6.

Small tent stakes 12 having a crucifix shape with round, upright shafts are driven into the ground up to the crossbar and ends 15 of the tubular sections 1 are slipped over the upright shafts of tent stakes 12. Likewise, ends 16 of leg pieces 5 are also slipped over the upright shafts of tent stakes 12 at the other end of the tent. Tent side flaps 17 then are fastened to ends 15 and 16.

Figure 7:
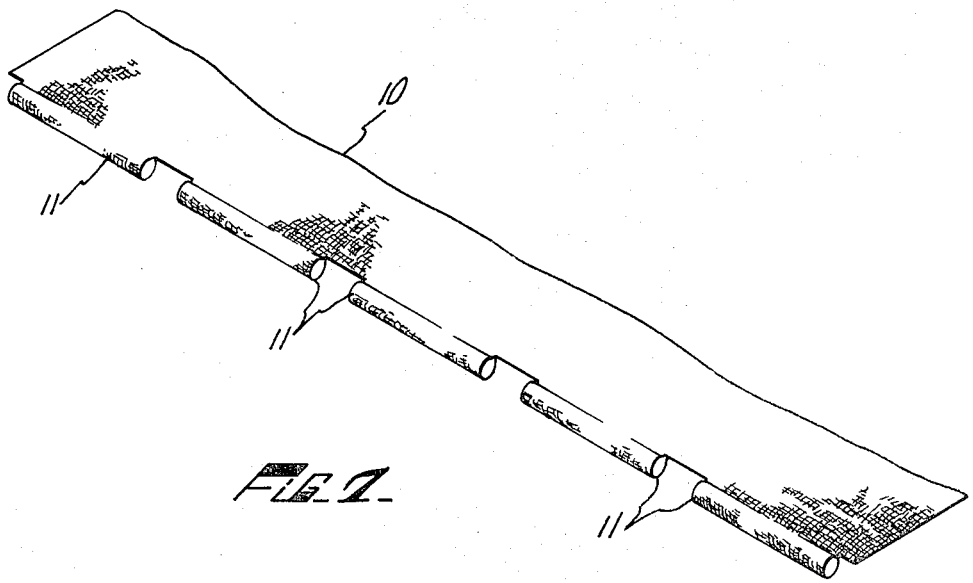
FIG. 7 is a view of the front edge of the tent showing the sleeves.

Referring to FIG. 7, the front edge 10 of the tent has several sleeves 11 sewn into the fabric suitable for threading the crown piece 2, roof pieces 3, and leg pieces 5 through. There are six sleeves 11 in the preferred embodiment, one for each of the crown, roof and leg pieces. The sleeves are slightly shorter than the corresponding frame piece threaded through them. They are also spaced apart such that the intersections 6 between the crown and roof pieces and the intersections 7 between the roof and leg pieces are not covered by sleeves. Referring again to FIG. 6, conventional guy wires or ropes 13 can then be attached by some suitable means to the tent frame at the front and open end of the tent to hold the tent frame up and keep the tent 8 taut. The side edges of tent 8 are held to the ground in conventional manner by tent stakes 12 as are the ground ends of ropes 13.

Although the invention has been described in terms of the preferred embodiment, other equivalent embodiments achieving the same function by similar means are intended to be included.

What is claimed is:

1. A backpack frame which is convertible into a tent frame comprising:

(a) a bottom portion of the backpack frame having at least two upright tubular sections and a bottom member holding said upright tubular sections in upright, parallel relationship, said bottom portion of said backpack frame serving as the rear support for the tent in the tent frame configuration;

(b) a top portion of the backpack frame adapted to fit together in two configurations, as alternately the top of a backpack frame and as the front support of a tent frame comprising:

(1) an arcuate, hollow crown piece having openings at its opposite ends for receiving at least two other frame members;

(2) at least two hollow roof pieces each having a curved end and a straight end and having outside dimensions slightly smaller than the corresponding inside dimensions of said openings in said crown piece said roof pieces for insertion into said openings in said crown piece in at least two different configurations, alternately as a portion of the top portion of the backpack frame wherein said curved ends of said roof pieces are inserted into said crown piece, and as a portion of the front support of a tent frame wherein said straight ends are inserted into said crown piece each said roof piece having openings in either end for receiving at least two other frame members;

(3) at least two leg pieces having outside dimensions slightly smaller than the corresponding inside dimensions of said openings in said ends of said roof pieces for insertion in said openings in said ends of said roof pieces, alternately to complete said front support of said tent frame when said roof piece is inserted in said crown piece in the tent frame configuration and to be received and stored within said roof piece when said roof piece is inserted in said crown piece in the backpack frame configuration.

2. A backpack frame which is convertible into a tent frame comprising:

(a) a bottom portion of the backpack frame made of lightweight, strong tubing generally formed in a "U" shape with the bottom of the "U" bent at an angle to the plane defined by the two, parallel, upright, tubular sections, said bottom portion of said backpack frame serving alternately as the bottom of the backpack frame and as the rear support for the tent in the tent frame configuration;

(b) a top portion of the backpack frame adapted to fit together in two configurations, alternately as the top of a backpack frame which fits into said two, parallel, upright, tubular sections of said bottom portion and as the front support of a tent frame comprising:

(1) a crown piece formed generally of lightweight, strong tubing in a curved "V" shape and having openings in its opposite ends for receiving two other frame members;

(2) two tubular roof pieces having an outside diameter slightly smaller than the inside diameter of said openings in said ends of said crown piece, each roof piece comprising a curved end and a long portion, said curved ends fitting in said openings in said ends of said crown piece in the backpack frame configuration and said long portions fitting in said openings in the ends of said crown piece in the tent frame configuration;

(3) two tubular leg pieces of straight, lighweight, strong tubing having an outside diameter slightly smaller than the inside diameter of said roof pieces for insertion into said long portions of said roof pieces in the backpack frame configurations for storage purposes, with said long portions fitting into said parallel, upright, tubular sections of the backpack frame, and for insertion into said curved ends of said roof pieces in the tent frame configuration.

3. The backpack frame defined in claim 1 or 2 further comprising:

(a) a backpack attached to said bottom portion of said backpack frame;

(b) a tent having a rear portion affixed to said backpack such that it may be rolled up and strapped to the bottom of said backpack and having sleeves formed in the front edge of said tent of dimensions to receive said crown piece, said roof pieces and said leg pieces to connect said tent to said crown, roof and leg pieces as assembled in the tent frame configuration, said tent having means for affixing the side edges thereof to the ground.

* * * * *